US011718468B2

(12) United States Patent
Jarisch et al.

(10) Patent No.: US 11,718,468 B2
(45) Date of Patent: Aug. 8, 2023

(54) PACK FOR PREPARING FOAMED FOOD OR BEVERAGE PRODUCTS

(71) Applicant: SOCIETE DES PRODUITS NESTLE S.A., Vevey (CH)

(72) Inventors: Christian Jarisch, Lutry (CH); Christophe Sebastien Paul Heydel, Chez-le-Bart (CH); Christian Talon, Vufflens-le-Chateau (CH)

(73) Assignee: Societe des Produits Nestle S.A., Vevey (CH)

( * ) Notice: Subject to any disclaimer, the term of this patent is extended or adjusted under 35 U.S.C. 154(b) by 383 days.

(21) Appl. No.: 16/648,723

(22) PCT Filed: Sep. 6, 2018

(86) PCT No.: PCT/EP2018/073996
§ 371 (c)(1),
(2) Date: Mar. 19, 2020

(87) PCT Pub. No.: WO2019/057504
PCT Pub. Date: Mar. 28, 2019

(65) Prior Publication Data

US 2020/0223625 A1 Jul. 16, 2020

(30) Foreign Application Priority Data

Sep. 19, 2017 (EP) ..... 17191841

(51) Int. Cl.
*B65D 85/804* (2006.01)
*B01F 23/232* (2022.01)
(Continued)

(52) U.S. Cl.
CPC ..... *B65D 85/8049* (2020.05); *B01F 23/232* (2022.01); *B01F 23/235* (2022.01);
(Continued)

(58) Field of Classification Search
CPC .. B65D 85/804–8067; B65D 2547/066; B01F 25/312; B01F 23/232; B01F 23/235
See application file for complete search history.

(56) References Cited

U.S. PATENT DOCUMENTS

2009/0235825 A1* 9/2009 De Graaff ..... B65D 85/804 99/287
2010/0239728 A1 9/2010 De Graaff
(Continued)

FOREIGN PATENT DOCUMENTS

EP 2343247 A1 * 7/2011 ..... B65D 85/8043
JP 2005529665 A 10/2005
(Continued)

*Primary Examiner* — Viren A Thakur
*Assistant Examiner* — Chaim A Smith
(74) *Attorney, Agent, or Firm* — K&L Gates LLP

(57) ABSTRACT

The invention relates to a pack (100) for preparing a food or beverage product from one or more food or beverage ingredients comprising an insert (10) and a container (20) where the ingredient or ingredients are stored, the insert (10) comprising at least a fluid inlet (110) configured for introducing an aqueous fluid under the form of a jet in the inner volume of the pack, the insert (10) further comprising at least an air conduit (130) configured to allow introducing air from the exterior of the pack and into the inner volume of the said pack through at least an air nozzle (132). The at least one fluid inlet (110) communicates with a depression chamber (200) through at least one liquid nozzle (120) in order to create a jet from a pressurized fluid introduced through the fluid inlet (110). The invention further relates to the use of a pack as described for preparing a food or beverage product.

16 Claims, 7 Drawing Sheets

(51) Int. Cl.

| | |
|---|---|
| ***B01F 23/235*** | (2022.01) |
| ***B01F 25/312*** | (2022.01) |
| ***B01F 23/237*** | (2022.01) |
| ***B01F 101/14*** | (2022.01) |

(52) U.S. Cl.
CPC ..... *B01F 25/312* (2022.01); *B65D 85/8046* (2013.01); *B65D 85/8052* (2020.05); *B01F 23/237611* (2022.01); *B01F 2101/14* (2022.01); *B65D 2547/066* (2013.01)

(56) References Cited

U.S. PATENT DOCUMENTS

| | | | | |
|---|---|---|---|---|
| 2013/0011521 | A1* | 1/2013 | Weijers ..... | B65D 85/8052 426/115 |
| 2016/0001970 | A1* | 1/2016 | Kaeser ..... | B65B 29/02 99/275 |

FOREIGN PATENT DOCUMENTS

| | | | |
|---|---|---|---|
| WO | 9905044 | | 2/1999 |
| WO | 2012146470 | | 11/2012 |
| WO | 2016204615 | A1 | 12/2016 |
| WO | 2017125267 | | 7/2017 |
| WO | 2017137286 | | 8/2017 |
| WO | 2017137371 | | 8/2017 |

* cited by examiner

PACK FOR PREPARING FOAMED FOOD OR BEVERAGE PRODUCTS

CROSS REFERENCE TO RELATED APPLICATIONS

The present application is a National Stage of International Application No. PCT/EP2018/073996, filed on Sep. 6, 2018, which claims priority to European Patent Application No. 17191841.0, filed on Sep. 19, 2017, the entire contents of which are being incorporated herein by reference.

FIELD OF THE INVENTION

The present invention relates to a pack for preparing a foamed food or beverage product from one or more food or beverage ingredients. In particular, the invention relates to a pack comprising an insert through which an aqueous fluid is introduced in the pack and a container where the ingredient or ingredients are stored.

BACKGROUND OF THE INVENTION

Preparing beverages by introducing a capsule containing a food or beverage ingredient, such as ground coffee or instant coffee, in a beverage dispensing machine and injecting water into the capsule is known in the state of the art: the beverage or food ingredient is typically extracted or dissolved into water to form the beverage or the desired final product, which flows out of the capsule through a suitable outlet.

As such, different capsules have been developed in the past, these capsules being at least differentiated by the nature of the capsule body used for storing the food or the beverage ingredient. While most of the capsules are made of a rigid body or semi-rigid body, typically made though injection moulding or thermoforming, flexible types of packs can be made out of foil materials. Flexible packs have generally the advantage to semi-rigid and rigid capsules that less amount of material is used to pack the product which leads to overall less production cost, to lower life cycle impact shown in several life-cycle assessments and to advantages on the part of the user, who will need less available space for storing these packs, as they are more compact.

It is known in the state of the art, for example as per document WO 99/05044, a flexible beverage-producing sachet comprising a beverage ingredient in a volume formed by bonding two laminates at their edges, having a base seam into which a conduit of rigid plastics is bonded. An inlet nozzle is provided at the top of the resulting sachet for introducing water that is mixed with the beverage or food ingredient inside the inner volume of the sachet, the beverage produced being then evacuated through a beverage outlet arranged at the bottom of the pack, where closing means are provided, such that the closing means are adapted to open under pressure when pressurized water is introduced into the sachet, allowing the beverage to evacuate through the beverage outlet.

Other arrangements of flexible beverage-producing sachets are also known in the state of the art. However, in these flexible sachets, when foaming of the food or beverage product is desired, an internal free space (free of food or beverage product, known as headspace), filled with air, is needed in order to obtain a foam when water is mixed with the food or beverage ingredient inside the inner volume of the sachet. Therefore, for a good foaming of the beverage or food product delivered, it is necessary to have high volumes of sachets where only some part of them is filled with the ingredients and the rest is just filled with air. The cost of these sachets is therefore higher, they are more bulky and require more volume for storing, and also the devices to which they are connected for preparing the final products are consequently bigger and more expensive.

It is therefore an aim of the present invention to provide a flexible pack having a minimized headspace volume and that is able to provide at the same time a very good quality foaming of the food or beverage product delivered.

The present invention comes to provide a solution to the above-described need, as it will be further explained. The invention also aims at other objects and particularly at the solution of other problems as will appear in the rest of the present description.

SUMMARY OF THE INVENTION

According to a first aspect, the invention relates to a pack for preparing a food or beverage product from one or more food or beverage ingredients comprising an insert and a container where the ingredient or ingredients are stored: the insert comprises at least a fluid inlet configured for introducing an aqueous fluid under the form of a jet in the inner volume of the pack, and the insert further comprises at least an air conduit configured to allow introducing air from the exterior of the pack and into the inner volume of the said pack through at least an air nozzle.

Preferably, the at least one fluid inlet communicates with a depression chamber through at least one liquid nozzle in order to create a jet from a pressurized fluid introduced through the fluid inlet. Typically, in a preferred embodiment of the invention, the at least one air nozzle communicates with the depression chamber so that air from at least one air conduit is sucked when the jet is introduced into the inner volume of the pack and together with said jet.

Preferably, the insert comprises at least two parts moveable with respect to each other. In a preferred embodiment, the insert comprises at least one fixed part adapted to be fixed to a beverage preparation device, this fixed part comprising at least one fluid inlet.

Typically, the insert comprises at least one moveable part, moveable with respect to a fixed part and comprising at least an air conduit.

In a preferred embodiment of the invention, the moveable part further comprises at least a beverage outlet.

Typically, in the pack of the invention, air is allowed to enter into the at least one air conduit once the two parts of the insert move with respect to each other.

Preferably, in the pack of the present invention, the communication of the insert with the inner volume of the pack remains closed until the two parts of the insert move with respect to each other. Also preferably, the communication of the insert with the exterior of the pack to deliver a food or beverage prepared remains closed until the two parts of the insert move with respect to each other.

According to the invention, the at least one air conduit can be made connectable to external means actively injecting air into the conduit, according to an embodiment of the pack of the invention.

The pack of the invention preferably comprises at least one flexible water impermeable sheet folded to define the inner volume of the pack and overwrapping the insert.

Typically, the insert comprises at least a frontal fluid inlet and at least a rear fluid inlet so that the pack can be accessed frontally and/or by the rear to introduce an aqueous fluid through one or the two sides.

According to the invention, preferably, the dimensions of the air conduit and/or of the air nozzle and/or the number and positions of them and with respect to the depression chamber defines the level of foaming of the food or beverage prepared.

Typically, the food or beverage ingredient in the pack of the invention is a soluble food or beverage ingredient.

According to a preferred embodiment, the container in the pack of the invention is configured as a sachet, a capsule or the like.

According to a second aspect, the invention relates to the use of a pack as the one described for preparing a food or beverage product.

BRIEF DESCRIPTION OF THE DRAWINGS

Further features, advantages and objects of the present invention will become apparent for a skilled person when reading the following detailed description of non-limiting embodiments of the present invention, when taken in conjunction with the appended drawings, in which.

DETAILED DESCRIPTION OF EXEMPLARY EMBODIMENTS

According to a first aspect, the invention relates to a pack 100 for preparing a food or beverage product from one or more food or beverage ingredients. As represented schematically in FIG. 10, the pack of the invention comprises an insert 10 and a container 20. The container 20 comprises in its inner volume the food or beverage ingredient(s), typically a soluble powder that will be dissolved by a fluid introduced inside the volume of the container through the insert 10. Typically, the fluid introduced through the insert 10 will be a liquid, preferably water.

The pack of the invention is preferably configured as a sachet by flexible films or sheets folded to conform the container 20. Other configurations could also be possible, for example configuring the container as a capsule, as a pod or the like. Preferably, the flexible films or sheets configuring the container 20 are arranged so as to overwrap the insert 10 in its entirety, except for the upper part of the insert, which is in communication with the inner volume of the pack. In a closed position, when the pack has not been used yet, the insert 10 is arranged inside of the pack, covered and overwrapped by these flexible sheets making up the container 20.

Figure 10:
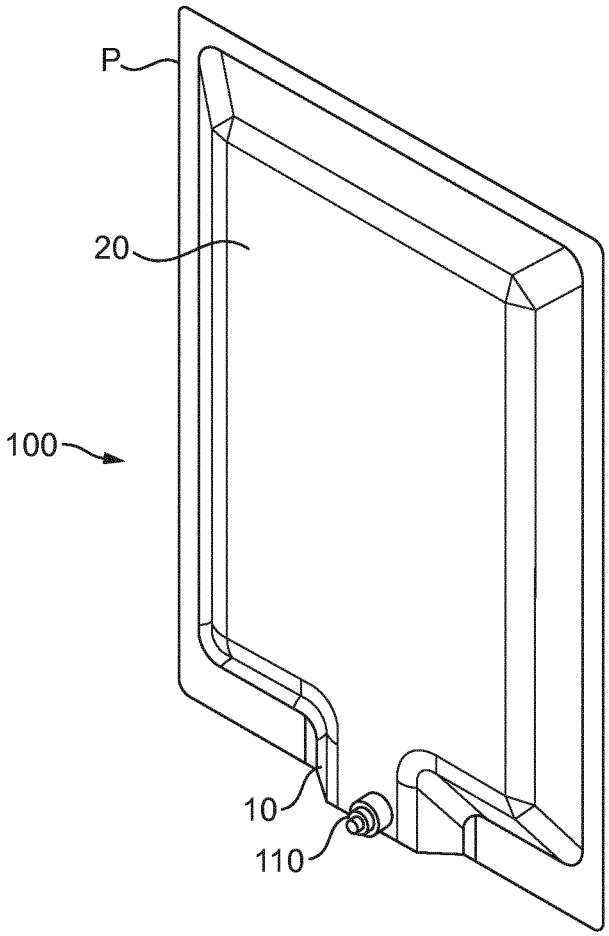
FIG. 10 shows schematically a pack for preparing foamed food or beverage products according to the present invention.

As schematically represented in FIG. 10, the pack essentially defines a vertical plane P, the insert 10 being arranged typically on one of the sides of the pack, preferably at the lower side of the pack.

Preferably, the pack 100 of the invention will comprise two flexible water impermeable sheets joined to one another to define the inner volume of the pack or of the container 20, where the product (typically powder) is stored and is further processed with water introduced through the fluid inlet 110 to prepare the beverage dispensed. The pack further comprises a beverage outlet 160 through which the beverage is delivered as a free flow.

The food or beverage ingredient of the container 20 in the pack 100 of the invention can be comprised within the list of: soups, fruit juices, vegetable juices, bouillons, coffee, chocolate, tea, milk or creamer, smoothies, purees, coulis, creams or a combination thereof. The food or beverage ingredient can be a soluble food or beverage ingredient. Preferably the food or beverage ingredient is a soluble food or beverage ingredient selected in the list of:

- instant coffee powder, milk powder, cream powder, instant tea powder, cocoa powder, soup powder, fruit powder or mixture of said powders,
- a coffee concentrate, a milk concentrate, a syrup, a fruit or vegetable concentrate, a tea concentrate, a fruit or vegetable puree.

The powders can be agglomerated or sintered. The powders or liquid concentrates can be mixed with solid pieces for example for preparing soups with solid pieces. The food or beverage ingredient can also be an infusable food or beverage ingredient like a roast and ground coffee or tea leaves. In that embodiment water extracts the infusable ingredient.

In the present invention fluid covers any aqueous diluent that can be mixed with a soluble beverage ingredient to prepare a beverage, like water, carbonated water, milk, etc. However, according to the invention, water is the preferred fluid which will be used.

The insert 10 comprises a fluid inlet 110 receiving a liquid, typically water, which is injected at a pressure higher than 2 bars, more preferably higher than 3 bars, preferably comprised between 2 and 10 bars, more preferably of around 7 bars. The fluid inlet 110 is configured in such a way that the high pressure fluid injected through it by external means (not shown) is converted into a high velocity jet in the inner volume of the container 20. This is done thanks to the restriction in diameter from the fluid inlet 110, communicating with the inner volume of the container 20 through a liquid nozzle 120 of a much reduced diameter, allowing the transformation of a high pressure jet into a high velocity jet. The fluid inlet 110 is communicated with a depression chamber 200 (that will be described later) through at least one liquid nozzle 120, having a diameter of at most 1 mm, preferably of at least 0.24 mm, preferably comprised between 0.3 mm and 1 mm, preferably between 0.3 and 0.5 mm, more preferably of about 0.4 mm. With such a configuration, when high pressure fluid is injected by external injecting means through the fluid inlet 110, it is conveyed internally towards the liquid nozzle 120, from which it is converted into a high velocity jet of fluid injected inside the depression chamber 200 when passing through the small section nozzle hole. Typically, this jet of fluid provided has a velocity of at least 20 m/s.

The insert 10 is preferably rigid and is made of a rigid plastic material, preferably by injection moulding. Typically, this plastic material can be selected from the following: polypropylene, polyethylene, polyethylene terephthalate and polylactic acid. Also according to a less preferred embodiment the fitment assembly 10 can be made of a metal like aluminium or tin-plate. The insert 10 of the invention is further provided with an air conduit 130 allowing the addition of air coming from outside the pack to the jet of fluid when conveyed in the inner volume of the pack 100 in order to obtain a good and stable foaming during the dissolution of the powder product comprised inside the container 20.

Preferably, injecting and piercing means will introduce a liquid under pressure, typically water, through the fluid inlet 110: as the inlet 110 is wrapped externally and is covered by the flexible sheet or film configuring the container 20, this needle will be configured to first pierce this film and then access the fluid inlet 110 through where the pressurized liquid will be injected (the needle typically comprises an inner duct or pipe through which high pressure fluid is injected in the fluid inlet 110).

Figure 1:
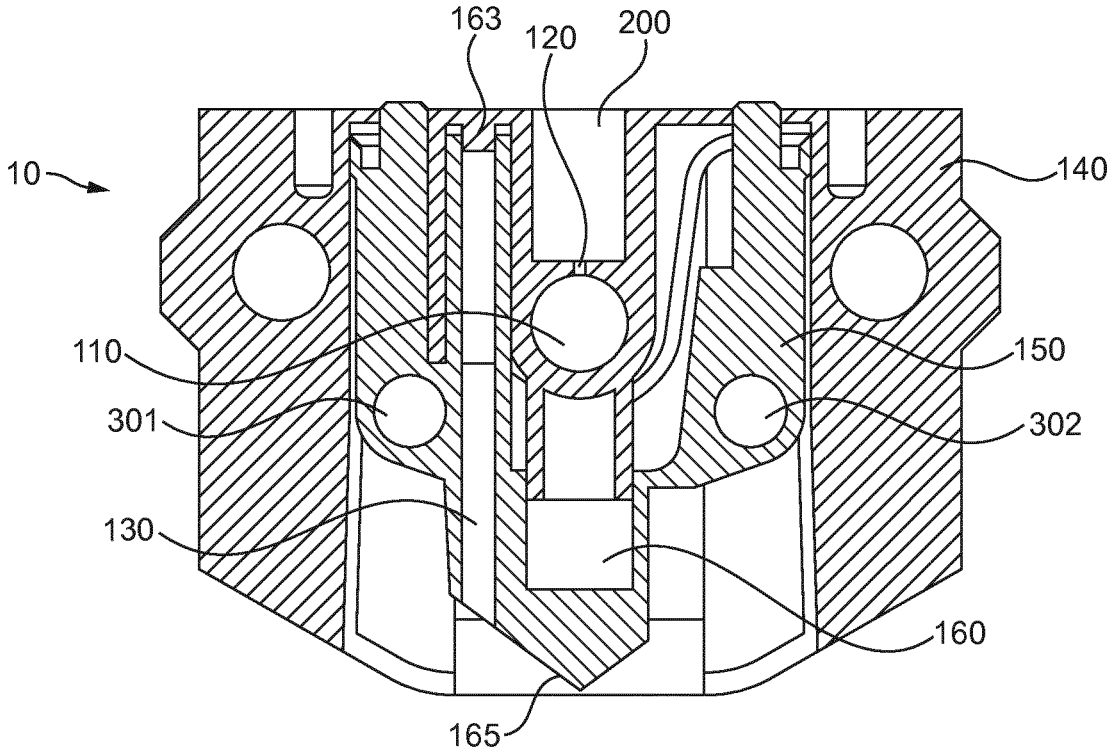
FIG. 1 shows a sectional frontal view of an insert in a pack for preparing foamed food or beverage products according to the present invention, representing a closed status of the insert.
Figure 2:
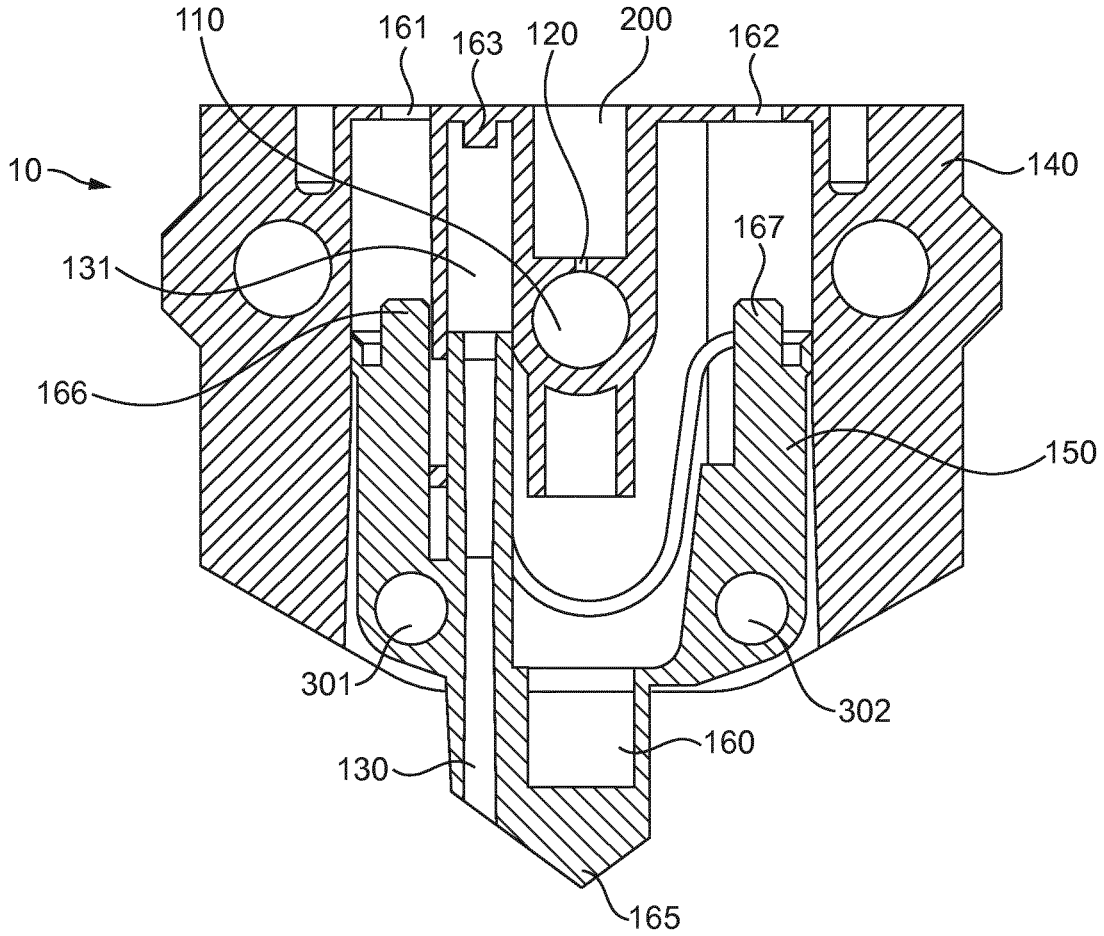
FIG. 2 shows a sectional frontal view of an insert in a pack for preparing foamed food or beverage products according to the present invention, representing an open status of the insert.
Figure 3:
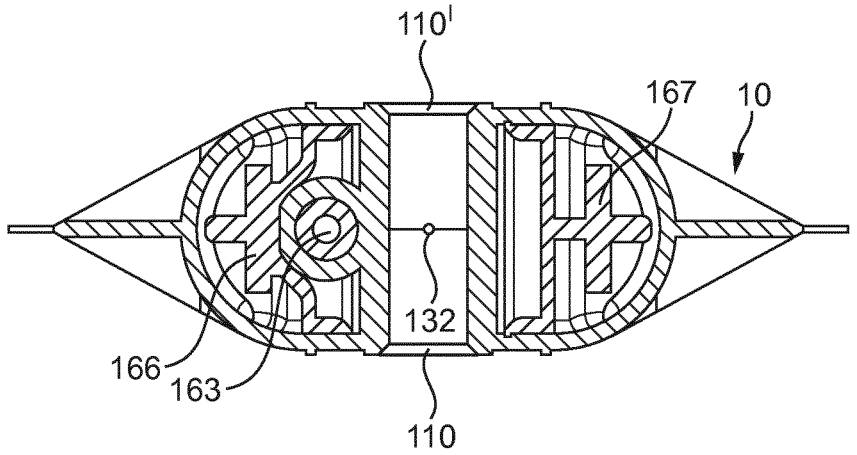
FIG. 3 shows an upper view of the insert represented in FIG. 1.
Figure 4:
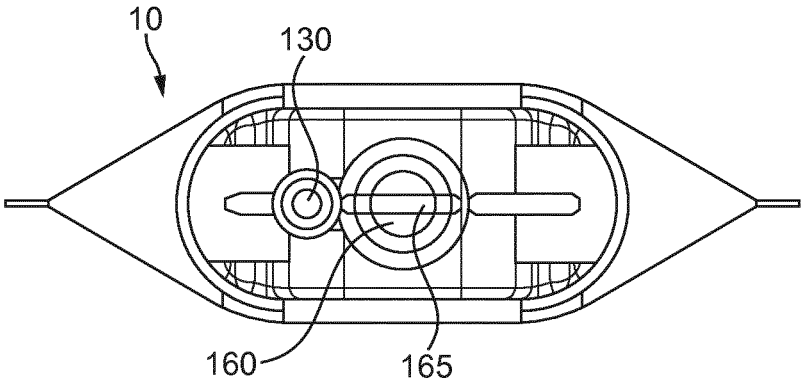
FIG. 4 shows a bottom view of the insert represented in FIG. 1.
Figure 5A:
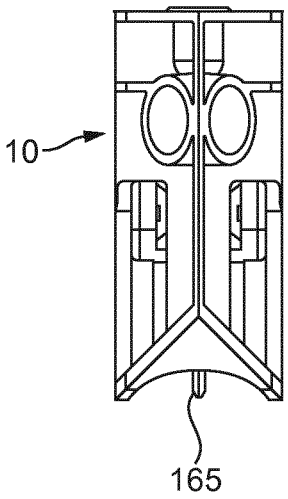
FIG. 5*a* shows a frontal view of an insert in a pack for preparing foamed food or beverage products according to the present invention, representing a closed status of the insert.
Figure 5B:
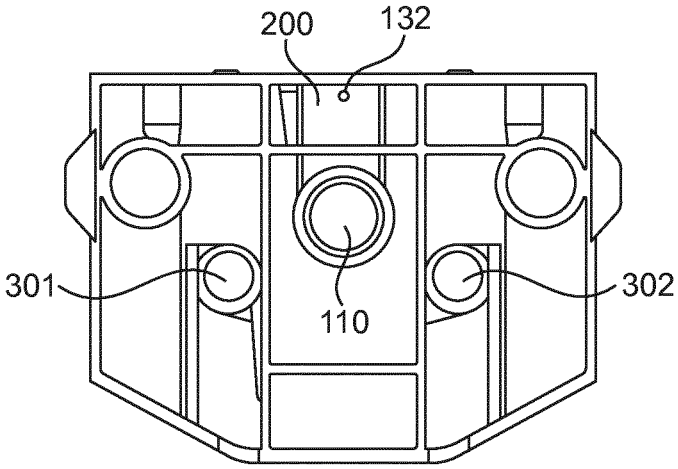
FIG. 5*b* shows a side view of the insert represented in FIG. 5*a*.
Figure 5C:
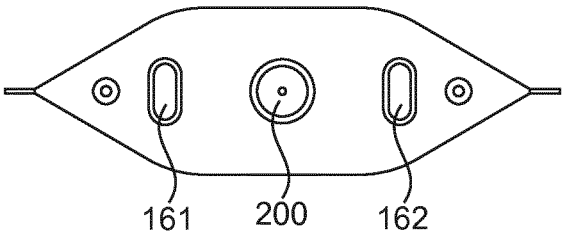
FIG. 5*c* shows a top view of the insert represented in FIG. 5*a*.
Figure 6:
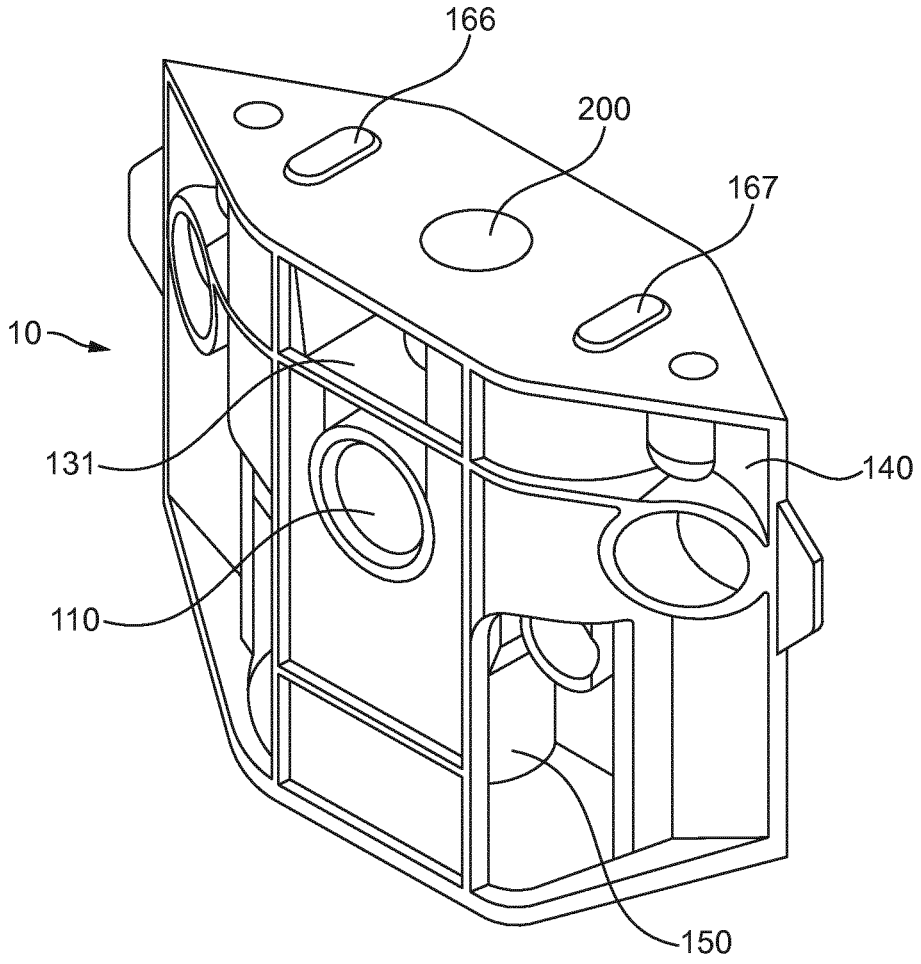
FIG. 6 shows an insert in a pack for preparing foamed food or beverage products according to the present invention, representing a closed status of the insert, and showing the two parts configuring said insert.
Figure 9:
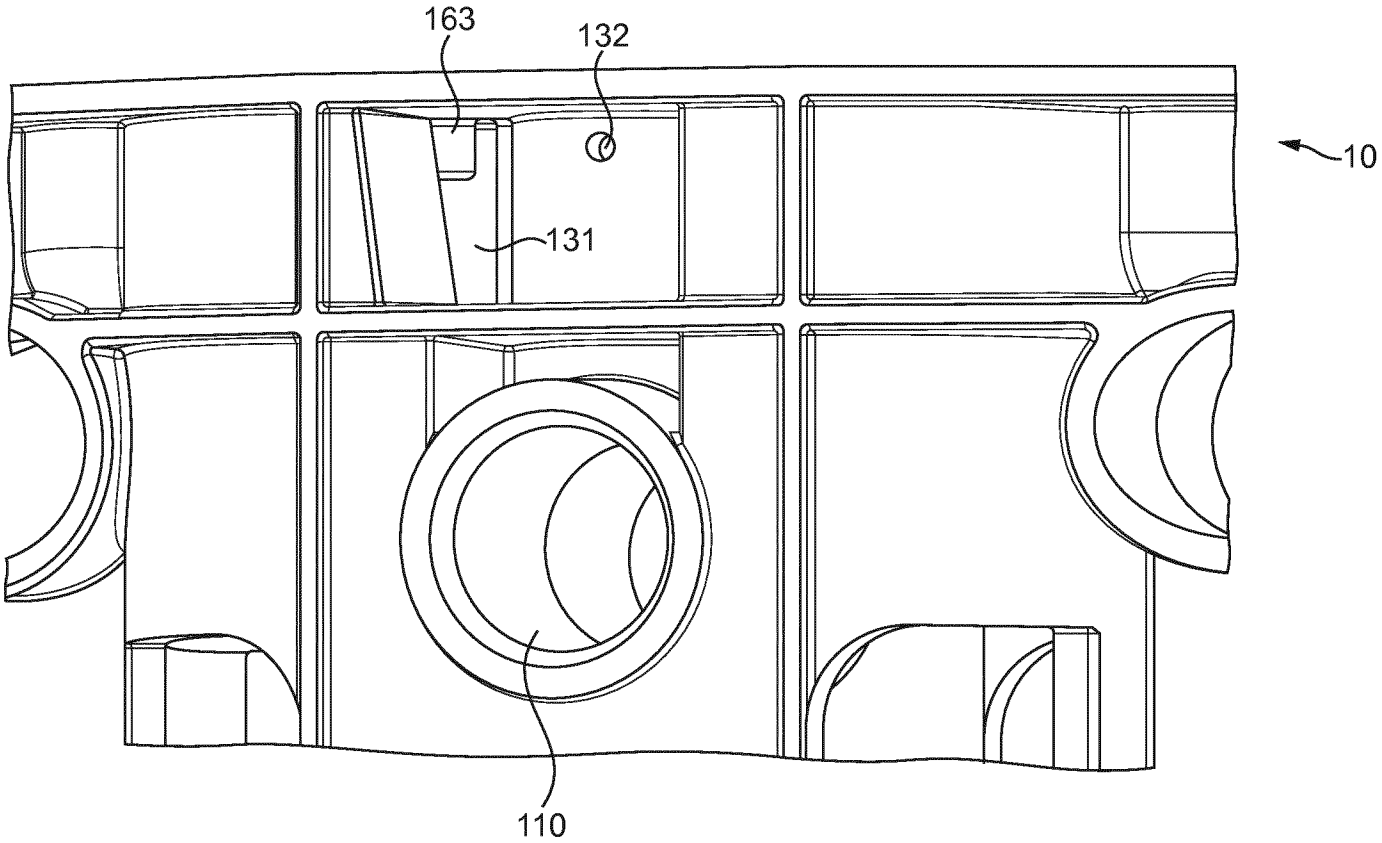
FIG. 9 shows a detailed view of the upper part of the insert represented in FIG. 6.

The insert 10 of the invention is configured in such a way that it comprises two parts, moveable with respect to each other. As represented in FIG. 1 or 2, the insert 10 comprises a fix part 140 (preferably fixed to a beverage extraction device) and a moveable part 150, which moves with respect to the fix part 140. When the moveable part 150 moves with respect to the fix part 140, a sharpened part 165 tears open the film overwrapping the lower side of the insert 10, allowing product to exit via the outlet 160 to the outside. When the moveable part 150 moves with respect to the fix part 140, two outlet apertures 161, 162 are left unblocked allowing product to go into the beverage outlet 160 and to be dispensed. As represented in FIGS. 1 and 2, the insert 10 further comprises an air conduit 130 communicating with an air chamber 131, which itself communicates through an air nozzle 132 with the inner volume of the pack 100 (see detail in FIG. 9). When the part 150 moves with respect to the part 140, the sharpened part 165 tears open the film covering the bottom of the insert 10 and leaves open the air conduit 130 to the outside, thus allowing that the air from the outside of the pack 100 goes into the air conduit 130, and from there into the air chamber 131, that was first blocked by the moveable part 150. The air chamber 131 (once open or accessible, when the moveable part 150 has moved with respect to the fix part 140) is closed in the frontal part of the insert 10 by a film or sheet that configures the container 20 and overwraps the insert, as it can be deduced from FIG. 9. The part 150 is in its close position with respect to the fix part 140 when the air conduit 130 is in contact with a stopping member 163. The moveable part 150 comprises closing elements 166, 167 that block the outlet apertures 161, 162 when in the close position, leaven these open with access to the product prepared towards the beverage outlet 160. The moveable part 150 is moved by means of an external part in a beverage preparation device connecting and moving this part through corresponding positioning pins 301, 302.

The injecting and piercing means (typically, a needle) in a beverage preparation device pierce the film covering the fluid inlet 110 and inject pressurized liquid (typically water) through this inlet, from which it goes through the liquid nozzle 120 (with a highly reduced diameter) into the depression chamber 200 where the pressurized fluid is converted into a liquid jet, at high velocity, and then into the inner volume of the container 20. This occurs while the insert 10 is in a closed position, as represented in FIG. 1. Preferably, as it can be seen in FIG. 7, the insert 10 can be accessed frontally or through its rear part, via a frontal fluid inlet 110, or via a rear fluid inlet 110', both communicating in a through hole traversing the insert 10, and communicating via the liquid nozzle 120 to the depression chamber 200; meaning that the consumer will not have to care on the way how the pack is placed in the machine, as it will be able to be accessed on both sides, i.e., the pack is made reversible. When the moveable part 150 displaces with respect to the fix part 140, as shown in FIG. 2, the air conduit 130 allows air in and into the air chamber 131. This air chamber 131 comprises air (the chamber is closed by the film overwrapping the insert 10) and, as a depression is created by the high velocity jet in this depression chamber 200, the air from the air chamber 131 is sucked through the air nozzle 132 into the chamber 200 and thus incorporated in the high velocity liquid jet, so when the beverage is prepared by dissolving the powder inside the pack with the water jet, the beverage provided is foamed with a good quality and stable foam. The beverage prepared is dispensed via the outlet apertures 161, 162 leading into the beverage outlet 160.

Figure 7:
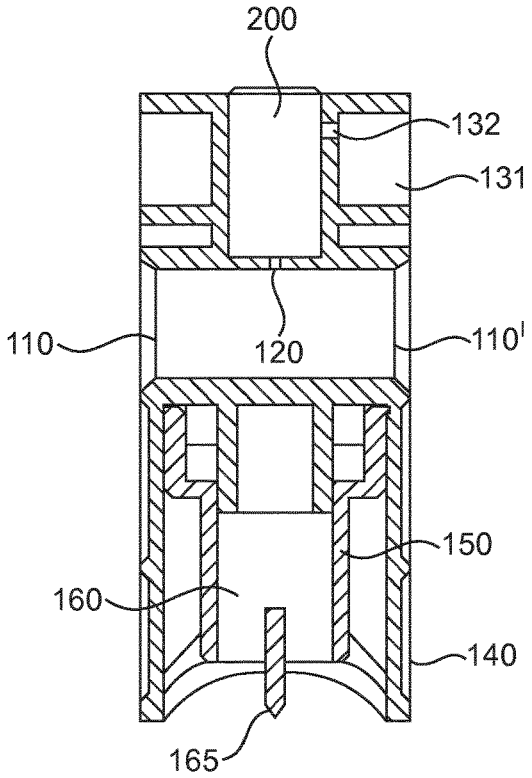
FIG. 7 shows a sectional side cut view of the insert represented in FIG. 6.
Figure 8:
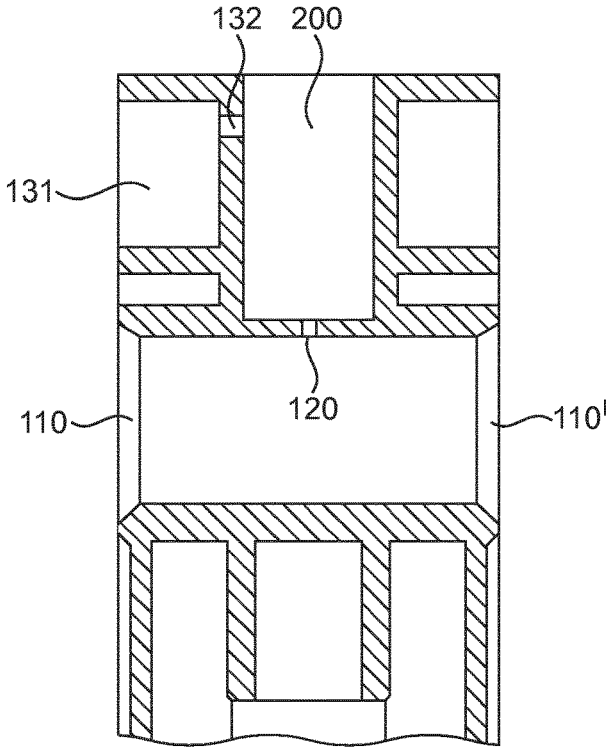
FIG. 8 shows a detailed view of the sectional side cut view of the insert represented in FIG. 7.

As represented in FIG. 7, or in further detail in FIG. 8, there is only one air nozzle 132 communicating with the depression chamber 200. However, further air nozzles can be provided according to other embodiments of the invention, depending on the quantity of air desired to be incorporated into the liquid jet, and thus depending on the foaming level desired.

According to the invention, the fluid inlet 110 can be configured for providing an orientable high velocity jet into the container 20, preferably at about 90° with respect to the fluid supply provided into the fluid inlet by the injecting and piercing means, though any other angle would be possible and comprised within the scope of the present application.

Although when it has been described, as a preferred embodiment, that the air conduit 130 passively allows air in from the outside of the pack, another possibility is to actively inject air into the air conduit 130 by external means, such as an air pump or the like. Therefore, the two typical configurations according to the invention would be: passive air aspiration (simply allowing external air into the air conduit 130 when the parts of the insert are in the position shown in FIG. 2) or active air injection when an active air pump is connected to the air conduit 130.

Although the present invention has been described with reference to preferred embodiments thereof, many modifications and alterations may be made by a person having ordinary skill in the art without departing from the scope of this invention which is defined by the appended claims.

The invention claimed is:

1. A pack for preparing a food or beverage product from one or more food or beverage ingredients, the pack comprising an insert and a container where the one or more food or beverage ingredients are stored, the insert comprising at least one fluid inlet configured for introducing an aqueous fluid under the form of a jet in an inner volume of the pack, at least one air conduit configured to allow introducing air from an exterior of the pack and into the inner volume of the pack through at least one air nozzle, and a moveable part moveable with respect to a fixed part of the insert, the moveable part comprising a beverage outlet and the fixed part comprising an outlet aperture, wherein the movement of the movable part with respect to the fixed part (i) causes a sharpened part of the insert to tears open a film overwrapping the insert, allowing the food or beverage product to exit via the beverage outlet, and (ii) unblocks the outlet aperture, allowing the food or beverage product to enter the beverage outlet and to be dispensed.

2. The pack according to claim 1 wherein the at least one fluid inlet communicates with a depression chamber through at least one liquid nozzle in order to create the jet from a pressurized fluid introduced through the at least one fluid inlet.

3. The pack according to claim 1, wherein the at least one air nozzle communicates with a depression chamber so that air from the at least one air conduit is sucked into the inner volume of the pack when the jet is introduced into the inner volume of the pack and incorporated together with the jet.

4. The pack according to claim 1 wherein the fixed part is adapted to be fixed to a beverage preparation device, the fixed part comprising the at least one fluid inlet.

5. The pack according to claim 1 wherein a communication of the insert with the inner volume of the pack remains closed until the moveable part moves with respect to the fixed part.

6. The pack according to claim 1 wherein a communication of the insert with the exterior of the pack to deliver the food or beverage product remains closed until the moveable part moves with respect to the fixed part.

7. The pack according to claim 1 wherein the at least one air conduit is connectable to an external means actively injecting air into the at least one air conduit.

8. The pack according to claim 1, wherein the film overwrapping the insert comprises at least one flexible water impermeable sheet folded to define the inner volume of the pack.

9. The pack according to claim 1, wherein the insert comprises at least a frontal fluid inlet on a front side and at least a rear fluid inlet on a rear side, so that the pack can be accessed from the front side and/or the rear side to introduce the aqueous fluid through the front side and/or the rear side.

10. The pack according to claim 1, wherein dimensions, a number, and a position of the at least one air conduit and/or the at least one air nozzle with respect to a depression chamber define a level of foaming of the food or beverage product.

11. The pack according to claim 1 wherein the one or more food or beverage ingredients is a soluble food or beverage ingredient.

12. The pack according to claim 1 wherein the container is configured as a sachet or a capsule.

13. The pack according to claim 1, wherein the movement of the movable part relative to the fixed part causing the sharpened part to tear the film open allows air to enter the at least one air conduit.

14. The pack according to claim 1 wherein the fixed part comprises at least one stopping element, and wherein an at least one air conduit of the movable part contacts at least one blocking element of the fixed part when the movable part is in a closed position.

15. The pack according to claim 1, wherein the movable part comprises a closing element, and the closing element of the movable part blocks the outlet aperture of the fixed part when the movable part is in a closed position.

16. The pack according to claim 1, wherein the fixed part is adapted to be fixed to a beverage preparation device, and the movable part comprises at least one positioning pin configured for movement by the beverage preparation device.

* * * * *